US007100802B2

(12) United States Patent
Sogaro

(10) Patent No.: US 7,100,802 B2
(45) Date of Patent: Sep. 5, 2006

(54) SINGLE-USE DISPENSING DEVICE AND METHOD OF MANUFACTURE

(75) Inventor: Alberto C. Sogaro, Kronberg (DE)

(73) Assignee: Dentaco Dentalindustrie-und Marketing GmbH, Homburg (DE)

( * ) Notice: Subject to any disclaimer, the term of this patent is extended or adjusted under 35 U.S.C. 154(b) by 0 days.

(21) Appl. No.: 11/152,570

(22) Filed: Jun. 14, 2005

(65) Prior Publication Data

US 2005/0281608 A1 Dec. 22, 2005

(30) Foreign Application Priority Data

Jun. 21, 2004 (DE) ..... 10 2004 029 702

(51) Int. Cl.
*B65D 35/08* (2006.01)
*B65D 35/14* (2006.01)
*B65D 35/16* (2006.01)

(52) U.S. Cl. ..... 222/107; 222/94; 401/133

(58) Field of Classification Search ..... 222/92, 222/94, 107, 212, 215; 401/132, 133
See application file for complete search history.

(56) References Cited

U.S. PATENT DOCUMENTS

| | | | | |
|---|---|---|---|---|
| 3,128,920 A * | 4/1964 | Volckening et al. | ..... | 222/215 |
| 4,871,091 A * | 10/1989 | Preziosi | ..... | 222/107 |
| 4,921,137 A * | 5/1990 | Heijenga | ..... | 222/107 |
| 6,557,731 B1 | 5/2003 | Lyon et al. | | |

FOREIGN PATENT DOCUMENTS

| | | |
|---|---|---|
| AT | 1 80 035 B | 10/1954 |
| AT | 187 036 | 10/1956 |
| BE | 5 47 093 | 5/1956 |
| BE | 62 703 | 12/1957 |
| DE | 3 66 638 C | 10/1920 |
| DE | 17 22 670 U | 5/1956 |
| DE | 11 10 076 B | 11/1956 |
| DE | 76 34 132 U1 | 7/1977 |
| DE | 31 22 237 A1 | 1/1983 |
| DE | 200 19 091 U1 | 5/2001 |
| DE | 100 20 853 A1 | 10/2001 |
| DE | 201 18 578 U1 | 3/2002 |
| DE | 201 07 507 U1 | 4/2002 |
| DE | 101 55 344 A1 | 5/2003 |
| DE | 202 08 450 U1 | 12/2003 |
| EP | 2 99 562 A1 | 1/1989 |
| GB | 1 297 302 A | 11/1972 |
| WO | WO 99/59891 A1 | 11/1999 |

* cited by examiner

*Primary Examiner*—Tuan Nguyen
(74) *Attorney, Agent, or Firm*—Quarles & Brady LLP

(57) ABSTRACT

A single-use dispensing device for dispensing liquid, pasty and other flowable and fluid substances includes a fillable and sealable plastic container for receiving a substance. The container has a neck end, a filling end opposite to the neck end, and lateral sealing seams defining a lateral contour of the container. An opening provided in the neck end extends through the neck end for dispensing the substance. A plug-like closure means for closing the opening extends throughout the neck end toward an outer portion of the neck end. A first transversal sealing seam extends transversely through the lateral sealing seams of the container at the outer portion of the neck end sealing the closure means from all sides. A tearable perforation seam provided in a portion of the neck end extends transversely through the lateral sealing seams. The perforation seam being displaced relative to the first transversal sealing seam towards the filling end of the container.

24 Claims, 2 Drawing Sheets

FIG. 1
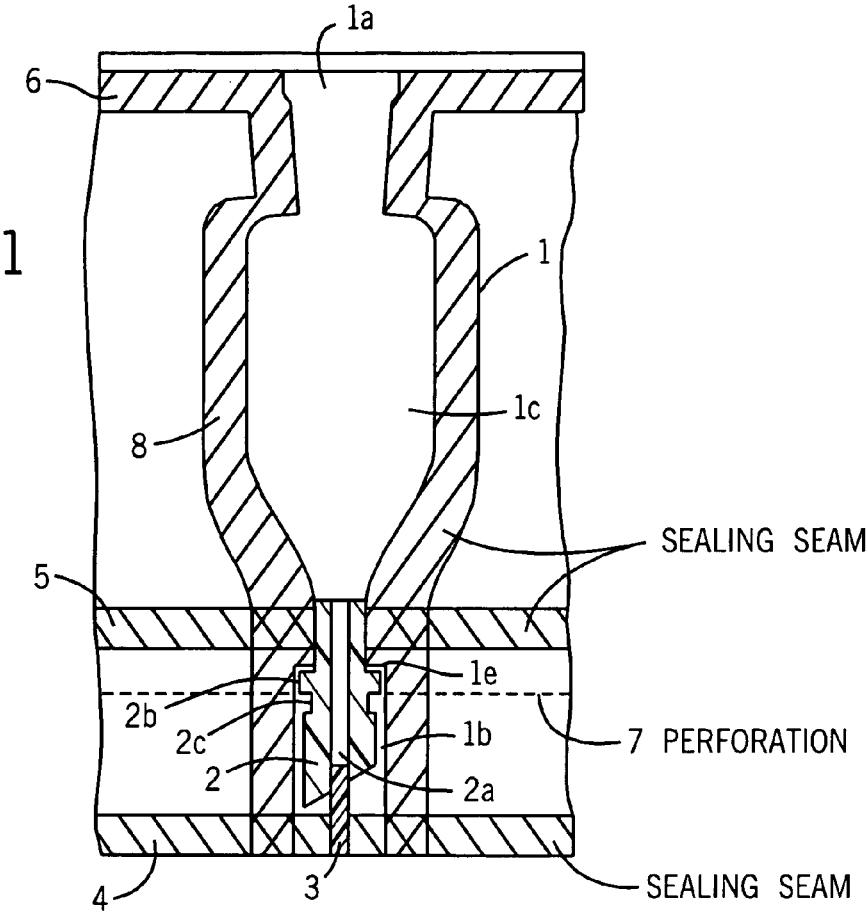
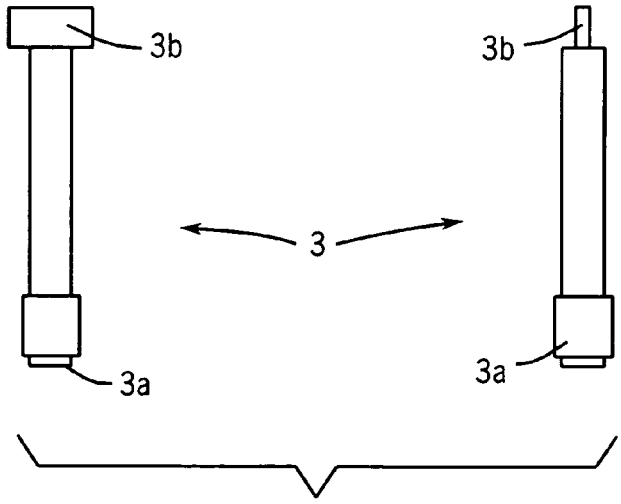
FIG. 2

SINGLE-USE DISPENSING DEVICE AND METHOD OF MANUFACTURE

CROSS REFERENCES TO RELATED APPLICATIONS

This application claims the priority benefit of German Patent Application NO. DE 10 2004 029 702.9 filed on Jun. 21, 2004.

STATEMENT REGARDING FEDERALLY SPONSORED RESEARCH

Not Applicable.

TECHNICAL FIELD

The present invention relates to a single-use dispensing device and a method for the manufacture of a single-use dispensing device for liquid, pasty, and other flowable or fluid substances which may comprise, for instance, gels, powders, pulverized substances and blends of said type of substances and materials.

DESCRIPTION OF THE BACKGROUND ART

Single-use dispensing devices for the substances referred to are used to a substantial extent in cosmetics and in medicine. They should be manufactured as economical as possible, on one hand, but should be reliable and easy to handle, on the other. In addition, the substance should be resistant in storage and transport and should remain leak proof.

A large variety of single-use containers having applicators are in existence (for instance U.S. Pat. No. 4,982,838, DE 100 09 629) comprising a reservoir for flowable substances, a discharge chamber to be opened by perforation or peeling means, and an applicator located in the discharge chamber. In some of the cases, the discharge chamber does not initially contain any substance and is filled with the substance only if, and when, a connection between a substance storage chamber and the discharge chamber is opened. Opening the connection, such as by the peeling or stripping-off a barrier or breaking of a perforation, often results in undesired spilling of the substance. In addition, if from the very beginning the substance is in a chamber in which the applicator is provided, a similar undesirable effect may be experienced.

SUMMARY OF THE INVENTION

An object of the present invention is to provide a single-use dispensing device and a method for the manufacture of a single-use dispensing device, wherein defined withdrawal of the substance is possible while no spontaneous spilling or dripping off of the substance will occur when opening and activating the single-use dispensing device.

The invention disclosed herein is applicable both to single-use dispensing devices having an applicator and to those having no applicator. In a preferred embodiment incorporating the present invention, a single-use dispensing device including applicator means for liquid, pasty and other flowable and fluid substances comprises a fillable and sealable plastic container to receive the substance. The container has a neck end and a filling end oppositely located to the end of the container where the neck is provided, and lateral sealing seams defining the lateral outer contour of the container. An applicator for dispensing and applying the substance through an opening extending through the applicator is inserted into the neck end of the container. In a non-activated state, a plug-like closure means closes the opening. A portion of the closure means protrudes or extends out of the applicator. The protruding portion is surrounded by the outer neck end, i.e. the outer portion of the neck end. A first transversal sealing seam runs transversely over the lateral sealing seams of the container at the outer neck end and seals from all sides the protruding portion of the closure means. A second transversal sealing seam preferably provided in the area of the inner neck end, i.e. the inner portion of the neck end, runs also transversely over the lateral sealing seams. The second sealing seam seals the applicator entirely. However, the applicator might be fastened in a different manner in the neck end and may for instance be sealed by gluing, welding or heat sealing. A breakable or tearable perforation seam extending transversely through the lateral sealing seams is provided in the section between the first and the second transversal sealing seam, and is offset or displaced towards the filling end, or towards the interior of the container, respectively, relative to the front end of the substance discharge end of the applicator.

By providing a closure means and by sealing-in the closure means into the first sealing seam, the closure means, when tearing off the perforation, is separated and detached together with the outer neck end from the remaining part of the container. Thereby, the closure means is automatically drawn out of the applicator opening. Thus the applicator is ready for operation and may be supplied via its passage or opening with the substance from the remaining container portion. At the instance of tearing off the perforation, the neck section is initially completely free from any substance. No spilling of the substance nor premature dripping off of the substance from the applicator, or the like, will occur.

The above principle, as well as, the advantages obtained therefrom can also be achieved with an alternative embodiment having no separately provided applicator, wherein the applicator is reduced to an application opening or substance discharge opening and the plug-like closure means is inserted directly into the neck end of the container. The plug-like closure means closes the substance discharge opening of the container and extends though a passage opening or through-hole of the neck end up to an outer portion thereof. A first transversal sealing seam extending transversely over the lateral sealing seams of the container at an outer portion of the neck end seals from all sides a corresponding portion of the closure means. A breakable or tearable perforation seam extending transversely over the lateral sealing seams is provided so that it is displaced towards the inside or interior of the container relative to the first sealing seam and that it is adjacent to the substance discharge opening. In view of the fact that the space or area between the perforation seam and the location where the closure means seals the neck end against the substance storing portion of the container is again free from any substance when the perforation seam is opened, premature spilling of the substance, when tearing the perforation open, is avoided by this embodiment of the present invention as well.

The single-use dispensing device can consist of only two parts, and if an applicator is to be provided, of three parts, namely: the container including the various applied seals and the perforation; if need be, the applicator; and the closure means. To put the three parts together, seals should simply be made or a perforation be provided, which can rapidly, precisely and reliably be made by prior art machines.

Sealing, as used herein, is understood to be accomplished by any method in which plastic walls can be connected with one another, such as hot and cold sealing, welding, for instance ultrasonic welding, and other cold forming measures suited for bonding plastic foils together.

Preferably, the container of the single-use dispensing device consists of a thermoplastic synthetic material manufactured in a way as common in the packaging of suppositories from plastic foils which after peripheral sealing are drawn by vacuum or, alternatively, by applying a pressure gas, into molds. In this way, a particularly economic single-use dispensing device can be manufactured to which the sealing seams of the invention can easily be applied. The container of the single-use dispensing device can be manufactured in an ampoule-like shape, open on top and on the bottom, and when the container so formed has been provided with the respectively desired applicator including closure means, it can be provided with the sealing and perforation seams.

In the case of the common blister packages for single-use dispensing devices for flowable substances having a cover foil which can be drawn-off from one or a plurality of deep-drawn container portions of the package, such a structure and procedure are not possible. In the case of the present invention, in addition, the form of the container which can be made as bulging out on both sides has the advantage that in order to activate the single-use dispensing device, the container, with material and wall strength suitably selected, can elastic-deformably be pressed together. After manually breaking the perforation and tearing-off an outer section of the neck end, a user may, in this way, by manipulating the closure means by single or repeated manual compression of the container activate the discharge opening or the applicator, respectively, to dispense the substance. In addition, the end of the plug-like closure means extending from the container bottom may be flattened for easily embedding into the first welding seam.

The plug-like closure means may be rod-like and is shaped so that it fits into the passage or through the opening of the container neck, or the applicator, respectively. At one end, it has preferably an enlarged diameter densely sealing the opening to the substance storing portion of the container.

This sealing end of the closure means, having for instance an enlarged diameter, need not have a circular cross-section if the adjoining portion of the closure means is elastically twistable. The diameter may, therefore, have an oval cross section or a more complicated cross sectional shape. With a view to the elastic twistability, such closure means may, when the perforation seam has been torn open, successfully be drawn out of the opening although they are not twistable within the opening because of the lacking rotational symmetry. More complicated cross sectional shapes may for instance occur if in an application the substance discharge is provided with an atomizer, a so-called diffuser, the closable discharge opening of which may be of a more complicated asymmetric cross sectional shape.

Preferably, the closure means extends only over a short distance into the front discharge opening of the applicator. In this way, it can easily be drawn out of the applicator when the neck end at the perforation is torn off. However, if the applicator includes for instance additional transverse channels extending to a foam jacket, or the like, in order to soak the applicator after removing the closure means, the closure means may extend further into the applicator opening in order to close these transverse channels as well.

The applicator may include a tapered or narrowed insert end which fits into the inner neck section adjoining the storage portion of the container, and may also include a groove in the area of which the perforation seam is provided.

In the simplest case, the applicator may be a small tube fitting into the inner end of the neck. The applicator may have a plurality of shapes. The applicator may, for instance, have an external flocking or foam jacket, a brush, a tapering discharge nozzle or the like as an application means for applying the substance. The applicator lies open in the area of the application means if the neck end of the container together with the closure means sealed-in in the neck end has been separated at the perforation seam.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF SUMMARY OF THE DRAWINGS

FIG. 1 is a schematic illustration of an embodiment of a single-use dispensing device according to the invention having an applicator;

FIG. 2 are two illustrations of an embodiment of a closure means for the single-use dispensing device of the invention under different angles of view diverging from one another by about 90°;

DETAILED DESCRIPTION OF THE PREFERRED EMBODIMENTS

Figure 4:
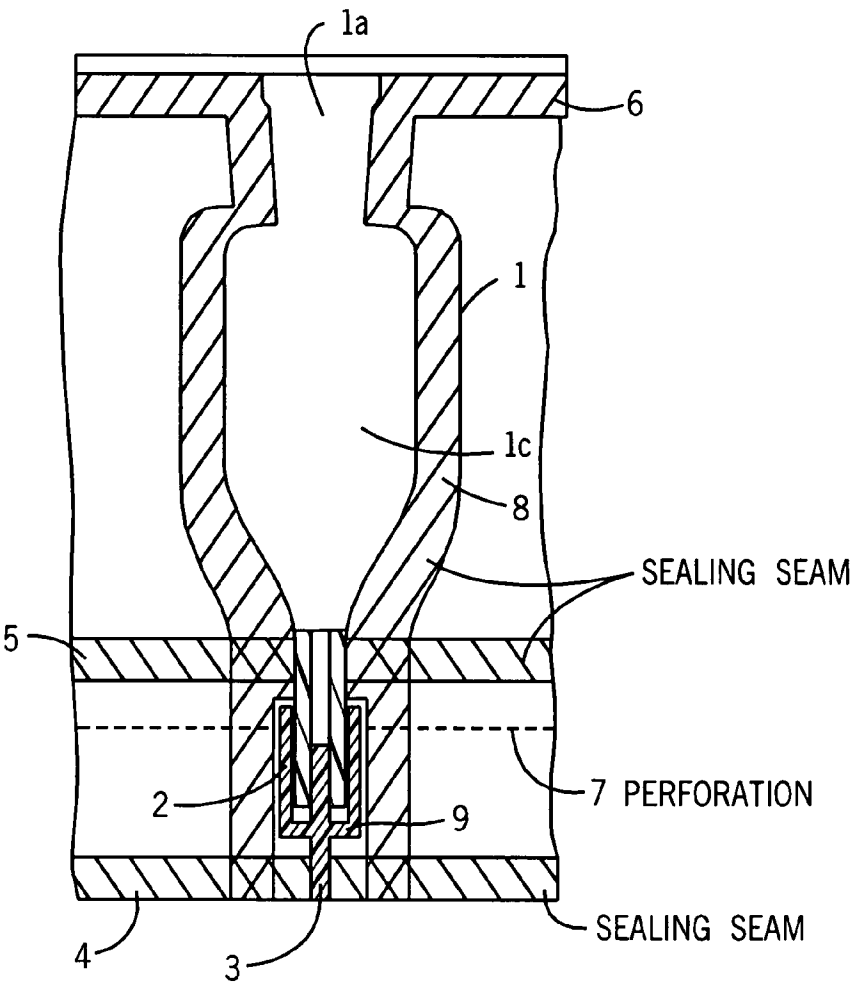
FIG. 4 is an illustration of a further embodiment of a single-use dispensing device according to the invention having an applicator and a protection cap.

The exemplified embodiment shown in FIG. 1 of a single-use dispensing device of the invention comprises a container 1 having a filling end 1*a*, a neck end 1*b*, a storage portion 1*c*, and lateral sealing seams 8 spaced from one another. The container 1 has the shape of an ampoule or vial and bulges out starting from its lateral sealing seams 8.

It is self-evident for one skilled in the art that the outlines or contour of the container 1, of its filling end and of its neck end may be changed in many ways. In case of a small ampoule, for instance, neck end 1*b* may not be narrowed as well or only insignificantly tapered or narrowed relative to the storage portion 1*c* of the container to be filled. This may be the case as well, if an applicator having a large diameter or an additional jacket for holding the applicator is provided in the neck end section.

Applicator 2 as depicted has a relatively small diameter compared to storage portion 1*c*, and neck end 1*b* is adapted to that smaller diameter. Applicator 2 has a passage or opening 2*a* in form of a longitudinal channel through which the respective substance from storage portion 1*c* can be applied via the applicator. The applicator has a tapered or narrowed section at its inner end which it is inserted into a narrow-mouthed zone of neck end 1*b*. Neck end 1*b* expands or widens adjoining to its narrow zone towards its outer portion, forming a surrounding step or shoulder 1*e*. Adjacent to this step 1*e*, neck end 1*b* has rather constant inner and outer diameters extending up to its most external open end. Applicator 2 includes a step-like enlargement 2*b* of its outer diameter adjacent to its narrowed section with which it is seated in the tight and narrow zone of the neck end. In the area of this enlarged outer diameter, a surrounding groove 2*c* is provided. As for the rest, applicator 2 maintains a constant outer diameter up to its front or outer substance discharge end. Applicator 2 does not extend through the entire neck end 1*b* but is rather dislocated towards the inside relative to the external end of the neck and 1*b*. As can be seen, applicator 2 has a beveled substance discharge end. In addition, applicator 2 may have, for instance a flocking means, not shown, on the outer side of the area having a larger outer diameter adjoining groove 2*c* and protruding from the groove 2*c* towards its outer front end.

At the substance discharge end of applicator 2, there is provided, in opening 2*a*, a plug-like closure means 3. An example of the closure means 3 having the shape of a rod-like closure member is shown in FIG. 2. The closure means 3 projects out of the applicator 2 and extends up to the outer front neck end. Of course, the closure means 3 can extend beyond the front neck end without departing from the scope of the invention.

In the embodiment shown in FIG. 1, closure means 3 is seated with a plug 3*a* formed at one end thereof in opening 2*a* of applicator 2 in the area of the substance discharge end thereof. At the end opposite to the end plug 3*a*, closure means 3 has a wing or bar 3*b* broadened relative to its normal diameter and flattened in order to make easier sealing possible. As already mentioned, it is an advantage, particularly in case of an end plug 3*a* that does not have a circular cross-section, to form at least a portion of closure means 3 between the two ends thereof, for instance between end plug 3*a* and broadened bar 3*b*, in an elastically twistable manner.

The manufacture of the dispensing device is preferably carried out in accordance with a molding and deep drawing process common in the production of suppository packings. In this process, the container 1 open on both sides is produced from two thermoplastic synthetic foils brought into contact with one another. Initially, the plastic foils are sealed together, at 8, at the outlines or contour of the side edges of the desired container. In this way, the lateral sealing seams 8 extending from the open filling end 1*a* to the front area of the open neck end 1*b* shown in the embodiment are produced. Subsequently, the foils are heated in the portions to be deformed and are drawn, as a rule by vacuum or, alternatively, by a pressure gas into molds having the form of a container. The molds correspond to the desired shape of the ampoules or vials. In this way, continuous chains of ampoules open on both sides and of variable shapes and material thicknesses are produced rapidly and rationally.

If it is intended that the manufacturer of these sealable receptacles open on top and on the bottom should also perform the insertion of the applicator and the filling stage with the substance, it is possible to insert, on the same production line, first the applicator 2 including closure means 3 into the narrowed section of neck end 1*b*. Alternatively, it is also possible to subsequently insert closure means 3 into the already installed applicator 2.

Subsequently, transversal sealing seams 4 and 5 and a perforation seam 7 are formed. The first transversal sealing seam 4 is produced by means of a common sealing station so that it extends transversely through the lateral sealing seams 8 of the container at the outer neck end and completely seals the broadened bar portion 3*b* of closure means 3. The second transversal sealing seam 5 is produced in the area of the narrowed or tapered inner portion of neck end 1*b* and extends transversely through the lateral sealing seams 8 sealing in this way applicator 2 in the tapered area thereof. Perforation seam 7 extending transversely to the lateral sealing seams 8 is provided in the area between the first and the second transversal sealing seams 4, 5 and it is set off or dislocated towards the inside relative to the front substance discharge end of applicator 2. This may be made either before or after producing the transversal sealing seams 4, 5.

Then, a filling station is passed and subsequently again a sealing station in order to close the filling end 1*a*. In the shown embodiment, laterally to the filling end a transversal sealing seam 6 has already been provided adjoining the lateral sealing seams 8 of the not yet closed container. Over this transversal sealing seam 6 an additional continuous transversal sealing seam is formed in order to close the container at the filling end 1*a*. The filling end could be closed in a different way as well, which as a rule, however, is less productive unless the device shown is combined with further means as explained further below.

Finally, the manufactured individual single-use dispensing devices are separated from each other. It is also possible to provide perforation separating lines between the single-use dispensing devices so manufactured and to offer a complete chain of single-use dispensing devices connected by the foils. The user may then tear off a respective device. Finally, there is a possibility, to punch out the single-use dispensing devices, or to punch out within the chain the plastic foil areas between the single-use dispensing devices leaving only connecting strips. Alternatively, chains of single-use dispensing devices, unfilled, open on top and on the bottom, or individual single-use dispensing devices already punched out or separated inclusive of, or without, respectively, an applicator can be supplied, which may be filled and sealed on the buyer's premises.

Figure 3:
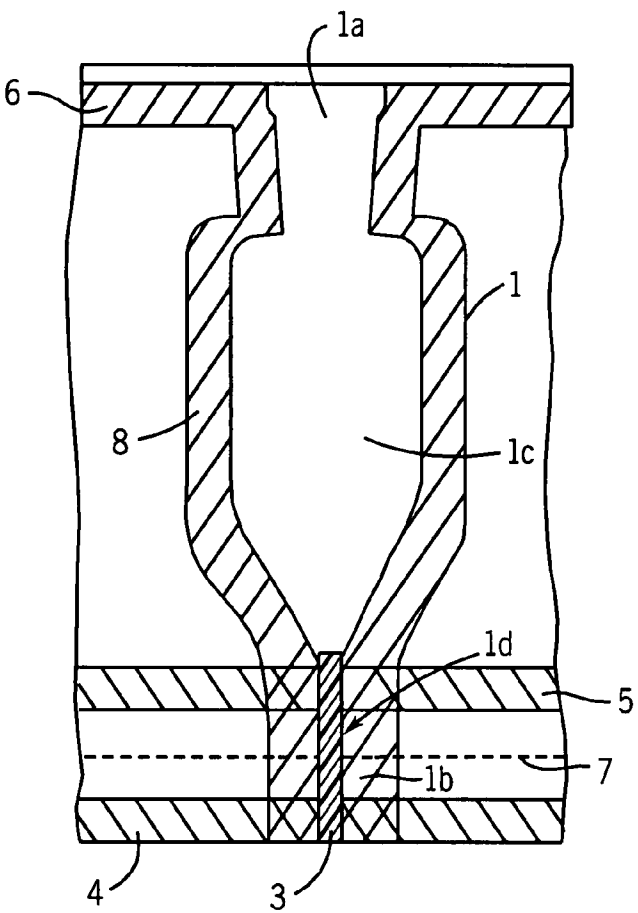
FIG. 3 is a schematic illustration of an embodiment of a single-use dispensing device according to the invention having no applicator.

The above features are also valid for the embodiment of the invention shown in FIG. 3 having no applicator. Closure means 3 may exactly be shaped as in FIGS. 1 and 2. Here, too, the end of the closure means seated within the neck is preferably sealed and made tight from all sides by the second transversal sealing seam 5. Alternatively, a sealed insertion of closure means 3 in the area where the passage of the neck passes over into the substance portion 12*c* of the container could be achieved by other releasable fixing means or may be achieved at a location displaced towards the first transversal sealing seam 4. A perforation seam 7 between the two transversal sealing seams 4 and 5 is also provided. In the area of perforation seam 7 later to be torn off, the substance discharge opening 1*d* of container 1 is located. When using an atomizer or the like, this substance discharge opening may be dislocated to the interior relative to the perforation seam 7. In this case, the shape of a plug 3*a* and the inner end of the closure means will be adapted to the particular discharge geometry of the atomizer. If the discharge geometry is not suited for a plug having a round diameter or circular cross-section, it is preferable to use a closure means including the above-referenced torsional-elastic portion which can twist during the tearing-off process.

Preferably, closure means 3 also extend into the area of the first transversal sealing seam 4 and, if necessary, even beyond. Advantageously, when tearing off the perforation and drawing off the front portion of the dispensing device, the closure means is drawn out of its fixation in container neck 1*b* and no spilling of the substance will occur. The substance is discharged by pressing onto the container to force the substance through discharge opening 1*d*. The invention can also be utilized in arrangements wherein the filling end is closed for instance with a stamp or a plunger which is pushed into container 1 to discharge the substance.

The above explained features relating to a production process also apply for the arrangement shown in FIG. 3 wherein only closure means 3 instead of applicator 2 has to be inserted into the neck. Preferably, the removable closure means 3 is installed as shown in FIG. 3 wherein an enlarged inner end or plug of the closure means is located in the most inner end of the neck.

In FIG. 4, a further variant is shown wherein a closure means 3' is provided with a cylindrical cap 9 attached to a portion of closure means 3' that extends into container 1. Cap 9 covers applicator 2'. This variant has the advantage that applicator 2' is additionally tightly sealed or encased. In particular in the area of perforation seam 7, applicator 2' is thereby reliably protected relative to the penetration of gas and water vapor from outside.

The single-use dispensing device (whether including a closable applicator means or not) may be provided with a plurality of storage portions located either in parallel or one after the other in series. In DE 100 09 629 referred to above, storage portions arranged one behind the other or in series are for instance shown which may be connected with one another for mixing the substances contained therein via passages which open when activating the device. It is also possible to insert one or more additional containers from the filling end into container 1. Thus the filling end may, contrary to the embodiment depicted, not be narrowed and receive a cylindrical container with a further substance.

This inner container may sealingly and telescopically be guided by surrounding beads along its outer side and/or the inner side of the container surrounding it. By providing openings in the container wall of the inner container and moving the containers one into the other, aimed mixing of the substances may be obtained which, as described above, can then be dispensed via the applicator. In this way, a plurality of containers can be arranged one behind the other, as revealed in U.S. Pat. No. 6,447,476 which is fully incorporated herein by reference. This principle may also be reversed and the original container 1 may be an inner container.

As the materials for the single-use dispensing device, all feasible plastic materials can be utilized. In the case of the preferred manufacturing method according to the above-referenced deep drawing process, thermoplastic materials, particularly composite films of thermoplastic materials having a barrier effect consisting for instance of PE, PET, PVDC, COC, aluminum intermediate layers etc. may be used. Moreover, the method described herein can produce containers of practically any shapes and material thicknesses which can be combined with any conceivable connecting device.

While there has been shown and described what are at present considered the preferred embodiments of the invention, it will be obvious to those skilled in the art that various changes and modifications can be made therein without departing from the scope of the invention defined by the appended claims.

I claim:

1. A single-use dispensing device for liquid, pasty and other flowable or fluid substances, said device comprising:

a fillable and sealable plastic container (1) for receiving a substance, said container having a neck end (1*b*), a filling end (1*a*) opposite to said neck end and lateral sealing seams (8) defining a lateral contour of the container;

an opening in said neck end for dispensing said substance;

a plug-like closure means (3) for closing said opening;

a first transversal sealing seam (4) extending transversely through said lateral sealing seams (8) of said container at said outer portion of said neck end and sealing said closure means (3); and a tearable perforation seam (7) extending transversely through said lateral sealing seams (8) and being displaced towards said filling end relative to said first transversal sealing seam (4).

2. The single-use dispensing device according to claim 1, wherein said container (1) consists of a thermoplastic synthetic material manufactured in a way as common when packing suppositories in plastic foils which after peripheral sealing are drawn by vacuum or, alternatively, overpressure by applying pressure gas, into molds.

3. The single-use dispensing device according to claim 1, wherein said container (1) is elastically deformable to press said substance into said opening below said neck end (1*b*).

4. The single use dispensing device according to claim 1, wherein said plug-like closure means (3) is rod-like and fits into said opening, while having at one end an enlarged diameter (3*a*) tightly sealing the opening.

5. The single-use dispensing device according to claims 1, wherein said closure means (3) is elastically twistable in a portion displaced to the inside relative to said first transversal sealing seam (4).

6. The single use dispensing device according to claim 1, comprising an applicator inserted into said neck end of said container, said opening extending through said applicator for dispensing said substance, a portion of said closure means protruding from said applicator, said protruding portion being surrounded by an outer portion of said neck end, and said first transversal sealing seam sealing from all sides said protruding portion of said closure means, and said tearable perforation seam being displaced towards a front substance dispensing end of said applicator.

7. The single-use dispensing device according to claim 6 comprising a second transversal sealing seam (5) extending transversely through the lateral sealing seams (8) in an area of an inner portion of said neck end and sealing from all sides of said applicator (2) or said closure means (3), respectively, said tearable perforation seam (7) being displaced relative to said outer portion of said neck end towards the inside of an area between said first and said second transversal sealing seams.

8. The single-use dispensing device according to claim 6, wherein said portion of said plug-like closure means (3) protruding from said applicator (3) or said substance dispensing opening (1*d*), respectively, includes a flattened end (3*b*) for better embedding in said first transversal sealing seam (4).

9. The single-use dispensing device according to claim 6, wherein said applicator (2) includes a narrowed insert end fitting into an inner neck area facing said filling end of said container (1) and includes a groove (2*c*) within the area of which said perforation seam (7) is provided.

10. The single-use dispensing device according to claim 6, wherein said applicator (2) includes an external flocking, a foam jacket, a dispensing nozzle or the like as an application means and is exposed in an area of this application means when said neck end (1*b*) of said container including the sealed-in closure means (3) has been broken away from said perforation seam (7).

11. The single-use dispensing device according to claim 6, wherein said closure means (3) extends into the through opening (2*a*) of the applicator (2) only in an area of an outer discharge opening of said applicator.

12. The single-use dispensing device according to claim 6, wherein a cap (9) is provided at said closure means (3'), said cap extending over said applicator (2') when said closure means (3') is inserted in said applicator (2').

13. A single-use dispensing device for liquid, pasty and other flowable and fluid substances, said device comprising:

a fillable and sealable plastic container (1) for receiving a substance, said container having a neck end (1*b*), a filling end (1*a*) opposite to said neck end and lateral sealing seams (8) defining a lateral contour of the container;

an opening (1*d*) provided in said neck end (1*b*) and extending through said neck end for dispensing said substance;

a plug-like closure means (3) for closing said opening (1*d*) and extending throughout said neck end toward an outer portion of said neck end;

a first transversal sealing seam (4) extending transversely through said lateral sealing seams (8) of said container at said outer portion of said neck end sealing from all sides said closure means (3); and a tearable perforation seam (7) provided in a portion of said neck end and extending transversely through said lateral sealing seams (8), said perforation seam being displaced relative to said first transversal sealing seam (4) towards said filling end of the container.

14. The single-use dispensing device according to claim 13 comprising a second transversal sealing seam (5) extending transversely through the lateral sealing seams (8) in the area of an inner portion of said neck end and sealing from all sides said said closure means (3), said tearable perforation seam (7) being displaced relative to said outer portion of said neck end towards the inside of an area between said first and said second transversal sealing seams.

15. The single-use dispensing device according to claim 13, wherein said container (1) consists of a thermoplastic synthetic material manufactured in a way as common when packing suppositories in plastic foils which after peripheral sealing are drawn by vacuum or, alternatively, overpressure by applying pressure gas, into molds.

16. The single-use dispensing device according to claim 13, wherein said container (1) is elastically deformable to press said substance into said opening, (1*d*) below said neck end (1*b*).

17. The single-use dispensing device according to claim 13, wherein said portion of said plug-like closure means (3) protruding from said substance dispensing opening, (1*d*) includes a flattened end (3*b*) for better embedding in said first transversal sealing seam (4).

18. The single use dispensing device according to claim 13, wherein said plug-like closure means (3) is rod-like and fits into said opening (1*d*) of said neck end (1*b*), while having at one end an enlarged diameter (3*a*) tightly sealing the opening of said applicator or of said neck end, respectively.

19. The single-use dispensing device according to claim 13, wherein said closure means (3) is elastically twistable in a portion displaced to the inside relative to said first transversal sealing seam (4).

20. A method for the manufacture of a single-use dispensing device for liquid, pasty and other flowable and fluid substances comprising the steps of:

manufacturing a container being provided for receiving a substance and initially having two open ends by bringing two thermoplastic synthetic foils in contact with one another, then sealing together said foils at contours of side edges of the desired container, thereafter, heating said foils and subsequently, by means of vacuum or, alternatively, overpressure, drawing or pressing said foils into molds disposed on both sides of said synthetic foils so as to provide, after cooling, a fillable and sealable plastic container having an open neck end and an open filling end opposite to the neck end and lateral sealing seams on both sides of the container, said neck end including an opening for dispensing and applying the substance;

inserting a plug-like closure means into the opening so that a portion of said closure means is surrounded by an outer portion of said neck end of said container;

applying a first transversal sealing seam extending transversely through the lateral sealing seams of said container at the outer portion of said neck end and sealing from all sides said portion of said closure means;

applying a tearable perforation seam so as to extend transversely through the lateral sealing seams and to be displaced towards said filling end relative to said first sealing seam; and closing the filling end of said container after it has been filled with the substance.

21. The method according to claim 20, comprising the step of applying a second transversal sealing seam in an area of an inner portion of said neck end so as to extend transversely through the lateral sealing seams and to seal from all sides of said closure means, said perforation seam being provided between said first and said second transversal sealing seams.

22. The method according to claim 20, including inserting an applicator into the neck end of said container, said opening extending through said applicator for dispensing and applying the substance, a portion of said closure means protruding from a substance dispensing end from said applicator and surrounded by an outer portion of said neck end of said container;

applying said first transversal sealing seam extending transversely through the lateral sealing seams of said container at the outer portion of said neck end and sealing from all sides said portion of said closure means protruding from said applicator; and applying said tearable perforation seam so as to extend transversely through the lateral sealing seams and to be displaced towards said filling end relative to said first sealing seam and relative to said front substance dispensing end of said applicator.

23. A method for the manufacture of a single-use dispensing device for liquid, pasty and other flowable and fluid substances comprising the steps of:

manufacturing a container being provided for receiving a substance and initially having two open ends by bringing two thermoplastic synthetic foils in contact with one another, then sealing together said foils at contours of side edges of the desired container, thereafter, heating said foils and subsequently, by means of vacuum or, alternatively, overpressure, drawing or pressing said foils into molds disposed on both sides of said synthetic foils so as to provide, after cooling, a fillable and sealable plastic container having an open neck end and an open filling end opposite to the neck end and lateral sealing seams on both sides of the container;

inserting a plug-like closure means into a through opening of said neck end so as to extend to an outer portion of said neck end;

applying a first transversal sealing seam extending transversely through said lateral sealing seams at said outer portion of said neck end and sealing from all sides said closure means;

applying a tearable perforation seam within the neck end so as to extend transversely through the lateral sealing seams and to be displaced, relative to said first transversal sealing seam, towards the filling end of the container, and closing the filling end of said container after it has been filled with the substance.

24. The method according to claim 23, comprising the step of applying a second transversal sealing seam in an area of an inner portion of said neck end so as to extend transversely through the lateral sealing seams and to seal said closure means, said perforation seam being provided between said first and said second transversal sealing seams.

* * * * *